US012195821B2

(12) United States Patent
Senoo

(10) Patent No.: US 12,195,821 B2
(45) Date of Patent: Jan. 14, 2025

(54) METHOD FOR MANUFACTURING STEEL STRIP FOR BLADE, AND STEEL STRIP FOR BLADE

(71) Applicant: Proterial, Ltd., Tokyo (JP)

(72) Inventor: Wataru Senoo, Tokyo (JP)

(73) Assignee: Proterial, Ltd., Tokyo (JP)

( * ) Notice: Subject to any disclaimer, the term of this patent is extended or adjusted under 35 U.S.C. 154(b) by 204 days.

(21) Appl. No.: 16/614,369

(22) PCT Filed: May 15, 2018

(86) PCT No.: PCT/JP2018/018685
§ 371 (c)(1),
(2) Date: Nov. 18, 2019

(87) PCT Pub. No.: WO2018/212155
PCT Pub. Date: Nov. 22, 2018

(65) Prior Publication Data

US 2020/0071790 A1 Mar. 5, 2020

(30) Foreign Application Priority Data

May 18, 2017 (JP) ..... 2017-098914

(51) Int. Cl.
*C21D 9/52* (2006.01)
*C21D 6/00* (2006.01)
(Continued)

(52) U.S. Cl.
CPC ..... *C21D 9/52* (2013.01); *C21D 6/002* (2013.01); *C21D 6/005* (2013.01); *C21D 6/008* (2013.01);
(Continued)

(58) Field of Classification Search
CPC .... C21D 6/002; C21D 2211/005; C21D 9/52; C21D 8/0236; C21D 2211/004; C21D 1/26
See application file for complete search history.

(56) References Cited

U.S. PATENT DOCUMENTS 6,143,241 A * 11/2000 Hajaligol ..... C22F 1/10 148/695
6,591,215 B1 7/2003 Blumenthal et al.
(Continued)

FOREIGN PATENT DOCUMENTS

CN 105102660 11/2015
CN 105247082 1/2016
(Continued)

OTHER PUBLICATIONS

"Office Action of India Counterpart Application", issued on May 31, 2021, with English translation thereof, pp. 1-6.
(Continued)

*Primary Examiner* — Anthony M Liang
*Assistant Examiner* — Jacob J Gusewelle
(74) *Attorney, Agent, or Firm* — JCIPRNET

(57) ABSTRACT

A method for manufacturing a steel strip for a blade and a steel strip for a plate, said method includes a batch annealing step for annealing a material for cold rolling having the aforementioned metal composition in a batch annealing furnace and a cold rolling step for forming a steel strip by performing cold rolling one or more times on the material for cold rolling that has been batch annealed. The batch annealing step includes a first uniform temperature step for maintaining heating for 1 to 12 hours at an internal furnace temperature exceeding 450° C. and less than 770° C. and a second uniform temperature step, carried out after the first uniform temperature step, for maintaining heating for 1 to 16
(Continued)

hours at an internal furnace temperature exceeding 770° C. and less than 900° C.

3 Claims, 1 Drawing Sheet

(51) Int. Cl.

| | |
|---|---|
| ***C21D 8/02*** | (2006.01) |
| ***C22C 38/02*** | (2006.01) |
| ***C22C 38/04*** | (2006.01) |
| ***C22C 38/22*** | (2006.01) |

(52) U.S. Cl.
CPC ..... *C21D 8/0205* (2013.01); *C21D 8/0236* (2013.01); *C22C 38/02* (2013.01); *C22C 38/04* (2013.01); *C22C 38/22* (2013.01); *C21D 2211/004* (2013.01)

(56) References Cited

U.S. PATENT DOCUMENTS

| | | | | |
|---|---|---|---|---|
| 9,783,866 | B2 * | 10/2017 | Fukada | C21D 9/46 |
| 2012/0321501 | A1 * | 12/2012 | Chae | C22C 38/18 164/463 |
| 2016/0032418 | A1 | 2/2016 | Fukada | |

FOREIGN PATENT DOCUMENTS

| | | | | |
|---|---|---|---|---|
| EP | 2982773 | | 2/2016 | |
| GB | 2258469 | | 2/1993 | |
| GB | 2258469 | A * | 2/1993 | C22C 38/18 |
| JP | S54121218 | | 9/1979 | |
| JP | H0539547 | | 2/1993 | |
| JP | 06145907 | A * | 5/1994 | |
| JP | H6-145907 | | 5/1994 | |
| JP | H0920923 | | 1/1997 | |
| JP | 2000015379 | | 1/2000 | |
| JP | 2007224405 | | 9/2007 | |
| WO | 2014162997 | | 10/2014 | |
| WO | WO-2014162997 | A1 * | 10/2014 | C21D 1/26 |

OTHER PUBLICATIONS

"Office Action of China Counterpart Application", issued on May 24, 2021, with English translation thereof, pp. 1-10.
"Office Action of Korea Counterpart Application", issued on Jun. 1, 2021, with English translation thereof, pp. 1-8.
"Search Report of Europe Counterpart Application", issued on Nov. 11, 2020, p. 1-p. 6.
"International Search Report (Form PCT/ISA/210)" of PCT/JP2018/018685, mailed on Aug. 14, 2018, with English translation thereof, pp. 1-3.
Office Action of China Counterpart Application, with English translation thereof, issued on Nov. 30, 2020, pp. 1-13.
Office Action of Korea Counterpart Application, with English translation thereof, issued on Jan. 25, 2021, pp. 1-8.

* cited by examiner

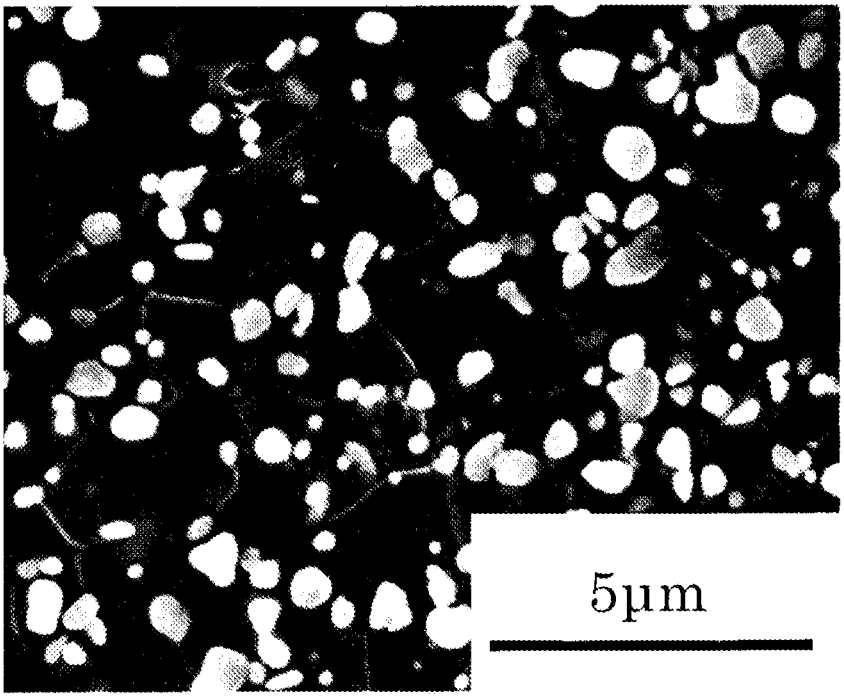
5μm

METHOD FOR MANUFACTURING STEEL STRIP FOR BLADE, AND STEEL STRIP FOR BLADE

CROSS-REFERENCE TO RELATED APPLICATION

This application is a 371 application of the international PCT application serial no. PCT/JP2018/018685, filed on May 15, 2018, which claims the priority benefit of Japan application no. 2017-098914, filed on May 18, 2018. The entirety of each of the above-mentioned patent applications is hereby incorporated by reference herein and made a part of this specification.

TECHNICAL FIELD

The present invention relates to a method for manufacturing a steel strip for a blade and a steel strip for a blade.

BACKGROUND ART

As a steel strip for a blade that is used for a blade such as a cutter, martensite-based stainless steel strip that includes, in percent by mass, 1.0% or less C and about 12.0 to 14.0% Cr with high hardness and excellent abrasion resistance and corrosion resistance is used. For such a martensite-based stainless steel strip, a high hardness structure can generally be obtained by performing cold rolling and softening annealing on a hot rolled steel strip after hot rolling to work the steel strip into a desired product shape, and then performing quenching and tempering.

The structure of the aforementioned steel strip for a blade before quenching and tempering is in a state in which a carbide is dispersed in a ferrite structure, and properties such as hardness vary depending on the distribution state of the carbide. Distribution of a carbide has been studied in many cases in the related art, and Patent Literature 1 that the applicant proposed in the past discloses an invention of a steel for a stainless razor with excellent quenching properties that includes, in percent by mass, more than 0.55% to 0.73% or less C, 1.0% or less Si, 1.0% or less Mn, 12% or more and 14% or less Cr, 0.2% or more and 1.0% or less Mo, 0% to 1.0% Ni with the remainder being Fe and impurities and that has a density of carbides in an annealed state of 140 to 200 particles/100 $\mu m^2$ in order to provide a steel for a stainless razor with excellent hardness achieved in a heat treatment in a short period of time, for example.

CITATION LIST

Patent Literature

[Patent Literature 1]
Japanese Patent Laid-Open No. H6-145907

SUMMARY OF INVENTION

Technical Problem

The steel for a stainless razor disclosed in Patent Literature 1 is an invention that provides excellent quenching properties and cold rolling properties, but it requires addition of the expensive raw material Mo in order to raise the density of the carbides, and no description of improving the density of the carbides without adding Mo is included, and thus there is still room for investigation. Thus, of the invention provides a method for manufacturing a steel strip for a blade and a steel strip for a blade, which enables control of the density of carbides within an appropriate range without adding Mo, with which an improvement in producibility can also be expected.

Solution to Problem

The inventor intensively studied heating conditions of a batch annealing furnace in order to obtain a steel strip that has an appropriate carbide density without containing Mo. As a result, the inventor discovered that properties that are equivalent to those of the steel strip in Patent Literature 1 containing Mo can be obtained by adjusting a temperature raising speed, a heating maintaining time, and a temperature of the batch annealing furnace within appropriate ranges, and thus conceived of the invention.

That is, according to an aspect of the invention, there is provided a method for manufacturing a steel strip for a blade that includes, in percent by mass, 0.55 to 0.80% C, 1.0% or less Si, 1.0% or less Mn, and 12.0 to 14.0% Cr with the remainder being Fe and inevitable impurities, the method including: a batch annealing step of annealing a material for cold rolling having the aforementioned composition in a batch annealing furnace; and a cold rolling step of forming a steel strip by performing cold rolling one or more times on the material for cold rolling that has been batch annealed, in which the batch annealing step includes a first uniform temperature step of maintaining heating for 1 to 12 hours at an internal furnace temperature exceeding 450° C. and less than 770° C. and a second uniform temperature step, carried out after the first uniform temperature step, of maintaining heating for 1 to 16 hours at an internal furnace temperature exceeding 770° C. and less than 900° C.

Preferably, a metal structure of the steel strip for a blade is a ferrite structure in which the carbide is dispersed, and a density of the carbide is 100 to 200 particles/100 $\mu m^2$.

Preferably, an average diameter of the carbide in the steel strip for a blade is 0.30 to 0.45 μm.

According to another aspect of the invention, there is provided a steel strip for a blade that includes, in percent by mass, 0.55 to 0.80% C, 1.0% or less Si, 1.0% or less Mn, and 12.0 to 14.0% Cr with the remainder being Fe and inevitable impurities, in which a metal structure of the steel strip for a blade is a ferrite structure in which a carbide is dispersed, and density of the carbides is 100 to 200 particles/100 $\mu m^2$.

Preferably, an average diameter of the carbide in the steel strip for a blade is 0.30 to 0.45 μm.

Advantageous Effects of Invention

According to the embodiment, it is possible to obtain a steel strip for a blade which enables control of the density of carbides within an appropriate range without adding expensive Mo and achieves more satisfactory producibility than a successive annealing scheme in the related art.

BRIEF DESCRIPTION OF DRAWINGS

FIG. 1 is an electron microscope photo showing a portion on a surface of a steel strip for a blade according to the invention.

DESCRIPTION OF EMBODIMENTS

Hereinafter, an embodiment of the invention will be described. However, the invention is not limited to the embodiment exemplified herein, and combinations and improvements can appropriately be made without departing from the technical idea of the invention. First, the reasoning behind the limitations on the composition of the steel strip for a blade according to the invention will be described.

C: 0.55 to 0.80%

C is an important element that adjusts the density of carbides to a density suitable for the invention, is dissolved from a carbide to a matrix at an austenitizing temperature during quenching, and determines hardness of martensite generated through the quenching. In order to obtain a density of carbides suitable for the invention, the content of C is 0.55% or more. A lower limit of C is preferably 0.60% and is further preferably 0.63%. In addition, since there is a possibility that excessive C content may lead to generation of a large eutectic carbide and degradation of corrosion resistance, an upper limit is set to 0.80%. The upper limit of C is preferably 0.78% and is further preferably 0.75%.

Si: 1.0% or less

Si is an element that is used as a deoxidizer during refining of the steel strip for a blade, is dissolved in the steel, and curbs softening during low-temperature tempering. However, since there is a high probability of excessive Si remaining in the steel for a blade as a hard inclusion such as $SiO_2$, and this may cause blade cracking and spot rust, the content is set to 1.0% or less. Also, the content is preferably within a range of 0.1 to 0.7% in order to secure a softening-resistance effect of Si at the time of low-temperature tempering and to prevent the hard inclusion from being formed. A further preferable lower limit of Si is 0.15%, and a further preferable upper limit of Si is 0.5%.

Mn: 1.0% or less

Mn can also be used as a deoxidizer during refining similarly to Si. However, since Mn exceeding 1.0% leads to degradation of hot workability, the content of Mn is set to 1.0% or less. Also, in a case in which Mn is used as a deoxidizer, a considerable amount of Mn remains in the blade steel. Therefore, although no specific lower limit of Mn is defined, the lower limit exceeds 0%. A preferable range of Mn is 0.1 to 0.9%.

Cr: 12.0 to 14.0%

Cr is an important element that maintains excellent corrosion resistance that the steel strip for a blade has and forms a Cr-based carbide that is necessary to obtain a density of carbides suitable for the invention. In order to obtain the aforementioned effect of Cr, at least 12.0% Cr is required. Meanwhile, if Cr exceeds 14.0%, the amount of crystallized eutectic carbide increases, and this may cause blade cracking in the blade. Therefore, the content of Cr is set to fall within a range of 12.0 to 14.0%. A lower limit of Cr suitable for more reliably obtaining the aforementioned effect of Cr is 12.5%, and a preferable upper limit of Cr is 13.5%.

In the invention, constituents other than the aforementioned constituents are Fe and inevitable impurities. Although Mo is added specifically to raise the density of carbides in the related, Mo is not added here in order to reduce raw material costs and obtain a density of carbides suitable for the invention. Other inevitable impurity elements include P, S, Cu, Al, Ti, N, and O, and these may be contained within the following ranges within which these constituents do not inhibit the effects of the invention.

$P \leq 0.03\%$, $S \leq 0.005\%$, $Cu \leq 0.5\%$, $Al \leq 0.1\%$, $Ti \leq 0.1\%$, $N \leq 0.05\%$, and $O \leq 0.05\%$ Next, a manufacturing method according to the embodiment will be described.

In the embodiment, the steel strip for a blade is produced by using a hot rolled material with the aforementioned composition as a material for cold rolling, performing batch annealing on the material for cold rolling (batch annealing step), and performing cold rolling on the material for cold rolling after the batch annealing one or more times (cold rolling step). Here, for the purpose of removing scales and rolling marks that are present on the surface of the material after the hot rolling, the surface of the hot rolled material may be polished before moving on to the batch annealing step.

[Batch Annealing Step]

In the embodiment, the material for cold rolling wound in a coil shape (hereinafter, also referred to as a coil) is batch-annealed in a vacuum using a batch annealing furnace before the cold rolling step. Since it is possible to anneal a plurality of coils at once by applying this batch annealing, annealing can be performed with higher producibility than successive annealing. The embodiment is characterized by annealing conditions for the batch annealing that include a first uniform temperature step of heating the material at a temperature that is lower than a transformation point of the material as pre-heating to precipitate a minute carbide and a second uniform temperature step, carried out after the first uniform temperature step, of heating the material at a temperature that is equal to or greater than the transformation point of the material to form the carbide into a spherical shape. In the first uniform temperature step in the embodiment, the heating is maintained at an internal furnace temperature exceeding 450° C. and less than 770° C. for 1 to 12 hours. Through the process, it is possible to precipitate a minute carbide with similar particle sizes. In a case in which the internal furnace temperature is 450° C. or less or a heating maintaining time is less than 1 hour, the carbide is not sufficiently precipitated, which is unfavorable. In a case in which the temperature is 770° C. or more or the heating maintaining time exceeds 12 hours, carbide particles that have excessively grown cause aggregation, and the final number of carbide particles decreases, which is unfavorable. A more preferable lower limit of the temperature is 470° C. A further preferable lower limit of the temperature is 600° C. A further preferable lower limit of the temperature is 750° C. Also, a more preferable lower limit of the heating maintaining time is 3 hours, and a more preferable upper limit of the heating maintaining time is 9 hours. A further preferable upper limit of the heating holding time is 8 hours, and the most preferable upper limit of the heating holding time is 7 hours. Also, the "transformation point" in the embodiment indicates an Ac1 point (a temperature at which generation of austenite is started) unless particularly indicated otherwise.

The embodiment includes the second uniform temperature step of maintaining heating for 1 to 16 hours at an internal furnace temperature exceeding 770° C. and less than 900° C. after the first uniform temperature step as described above. By setting the temperature of the second uniform temperature step to exceed 770° C., which is equal to or greater than the transformation point of the material, and less than 900° C., it is possible to reduce the carbide that is dissolved in the material, to perform a heat treatment to form the material into a spherical shape as described above, and to raise the density of the carbide. If the internal furnace temperature is 770° C. or less, the structure is not austenitized, the carbide becomes large and coarse, and there is a possibility of formation in a spherical shape not sufficiently advancing, which is unfavorable. If the temperature is 900° C. or more, the carbide is excessively dissolved, and the carbide that is reprecipitated during a gradual cooling step carried out thereafter tends to become large and coarse, which is unfavorable. A more preferable lower limit of the temperature is 800° C., and a more preferable upper limit of the temperature is 860° C. Also, an upper limit of the holding time of the second uniform temperature step is more preferably 13 hours and is further preferably 11 hours. In a case in which the holding time of the second uniform temperature step is less than 1 hour, dimensional failures and fracture of the steel strip tend to occur due to the excessively short holding time, which is unfavorable. Since the batch furnace is applied in the embodiment, and it is possible to put in a plurality of coils (for example, to put in ten coils with a maximum outer diameter size of ϕ1000 mm) while performing the tempering performed once, high producibility is achieved. Also, a gradual cooling step of gradually cooling the material is preferably performed until the material temperature reaches 600 to 800° C. (however, this has to be a temperature that is lower than the internal furnace temperature in the second uniform temperature step) after the second uniform temperature step in order to sufficiently precipitate the carbide in the material.

[Cold Rolling Step]

In the embodiment, it is possible to obtain a steel strip with a plate thickness adjusted to a desired plate thickness by performing cold rolling one or more times on the material for cold rolling after the batch annealing step. Also, the cold rolling may be performed a plurality of times, and intermediate annealing for softening the steel strip may be performed between cold rolling processes. Also, strain eliminating annealing may be performed for the purpose of eliminating strain after the final cold rolling.

[Metal Structure]

A metal structure before quenching and tempering of the steel strip for a blade obtained by applying the aforementioned manufacturing method according to the invention is a ferrite structure in which a carbide is dispersed, and the density of the carbide can be adjusted from 100 to 200 particles/100 $\mu m^2$. By setting the density within this range, it is possible to obtain a steel strip with excellent quenching properties. In a case in which the density of the carbide is less than 100 particles/100 $\mu m^2$, the amount of the dissolved carbide during the quenching decreases, and desired hardness tends to be unable to be obtained. In a case in which the density of the carbide exceeds 200 particles /100 $\mu m^2$, the hardness of the steel strip becomes high, and producibility tends to be degraded. A more preferable lower limit of the density of carbide is 120 particles/100 $\mu m^2$, a further preferable lower limit of the density of carbide is 130 particles/100 $\mu m^2$, and the most preferable lower limit of the density of carbide is 140 particles/100 $\mu m^2$. Also, a preferable upper limit of the density of carbide is 190 particles/100 $\mu m^2$, and a more preferable upper limit of the density of carbide is 180 particles/100 $\mu m^2$.

An average diameter of the carbide of the steel strip for a blade according to the invention before quenching and tempering is preferably 0.30 to 0.45 μm. By controlling the carbide size within the aforementioned range, the carbide tends to be easily dissolved during quenching. Also, it is more preferable that a large amount of a fine carbide with an average diameter of 0.30 μm to 0.40 μm be contained. It is possible to obtain more satisfactory quenching properties by mainly precipitating the fine carbide of 0.40 μm or less in this manner. Also, as a method of measuring the carbide in the embodiment, it is possible to measure the carbide by etching a surface (rolled surface) of the steel strip, observing the produced structure with an electron microscope at 10000× magnification, performing image analysis on the obtained image, and calculating the number and an average diameter (diameter corresponding to area circle) of the carbide particles, for example.

EXAMPLES

In the following examples, the invention will be described in further detail. A hot rolled material (10 coils with a size of ϕ1000 mm) with a thickness of 1.5 mm that had the composition of No. 1 in Table 1 was annealed in a batch furnace. The batch annealing was batch annealing including a first uniform temperature step of heating the material for 5 hours at 690 to 745° C. and a second uniform temperature step of heating the material for 6 hours at 800 to 850° C., and the material after the second uniform temperature step was gradually cooled to a temperature range from 600 to 750° C. Thereafter, cold rolling and intermediate annealing were repeated to finish the material with a thickness of 0.1 mm, thereby obtaining a steel strip for a blade in Invention Example 1. Also, in Invention Example 2, conditions of the first uniform temperature step were set to heating at 470 to 530° C. for 2 hours, the temperature of the second uniform temperature step was set to 800 to 850° C., heating thereof was set to 11 hours, and the other conditions were set to be similar to those of No. 1, thereby obtaining a steel strip for a blade. Meanwhile, hot rolled materials with a thickness of 1.5 mm that had compositions represented in No. 11 and No. 12 in Table 1 were batch-annealed (without the first uniform temperature step of the invention) for 5 hours in a batch furnace adjusted to 840° C., cold rolling and annealing were repeated in the same manner as the invention examples, and the materials were finished to have a thickness of 0.1 mm, thereby obtaining steel strips for a blade. The product with the composition of No. 11 is defined as Comparative Example, and the product with the composition No. 12 is defined as Conventional Example.

TABLE 1

(mass %)

| | C | Si | Mn | Cr | Mo | Remainder |
|---|---|---|---|---|---|---|
| No. 1 (No. 2) | 0.68 | 0.28 | 0.73 | 13.25 | — | Fe and inevitable impurities |
| No. 11 | 0.66 | 0.41 | 0.70 | 13.14 | — | Fe and inevitable impurities |
| No. 12 | 0.73 | 0.53 | 0.70 | 13.68 | 0.20 | Fe and inevitable impurities |

Next, samples for observation were collected from the steel strips for a blade produced in Invention Examples 1 and 2, Comparative Example, and Conventional Example, and densities of carbide were measured. Also, Vickers hardness in Invention Example 1, Comparative Example, and Conventional Example was measured. For measuring the densities of carbide, surfaces (rolled surfaces) of the samples were etched with an acid solution to expose the carbide, and observation was then performed using an electron microscope. The densities of carbide in 100 $\mu m^2$ were measured in the obtained images using an image analysis device. Also, an average diameter (area circle corresponding diameter) of the carbide was also measured using the image analysis device only in Invention Example 1. For the Vickers hardness, hardness at the centers of the steel strips in the width direction was measured with a load of 200 N in accordance with a method defined by JIS-Z2244. FIG. 1 shows an electron microscope photo of a metal structure in Invention Example 1. Also, Table 2 shows results of measuring the densities of carbide, and Table 3 shows results of measuring the hardness. Also, the average diameter of the carbide in Invention Example 1 was 0.35 μm. Also, as an additional experiment, a steel strip for a blade was produced by setting the temperature of the second uniform temperature step to 800 to 850° C., setting the heating to about 18 hours, and setting the other conditions to be similar to the conditions of Invention Example 1, and the density of carbide in the obtained sample was checked. As a result, it was confirmed that the density was less than 100 particles/100 $\mu m^2$.

TABLE 2

| | Composition | Density of carbide (particles/100 $\mu m^2$) |
|---|---|---|
| Invention Example 1 | No. 1 | 148 |
| Invention Example 2 | No. 2 | 173 |
| Comparative Example | No. 11 | 98 |
| Conventional Example | No. 12 | 150 |

TABLE 3

| | Composition | Hardness (HV) |
|---|---|---|
| Invention Example 1 | No. 1 | 209 |
| Comparative Example | No. 11 | 228 |
| Conventional Example | No. 12 | 245 |

It was confirmed from the results in FIG. 1 that the steel strip for a blade in Invention Example 1 had a metal structure in which a white carbide is dispersed in a ferrite structure. Also, it was confirmed from Table 2 that in the steel strips for a blade in Invention Examples 1 and 2, the densities of carbide were higher than that in Comparative Example in which substantially the same composition was used, and the densities of carbide were able to be adjusted to be equivalent or more than equivalent to that in Conventional Example in which Mo was added. Also, the steel strip for a blade in Invention Example 1 had hardness of HV200 or more, and it was possible to confirm that the value was not very different from that in Conventional Example. Further, it was possible to perform a heat treatment on ten coils at once in the batch annealing furnace in examples of the invention. Therefore, it is also possible to improve producibility according to the invention as compared with the successive annealing scheme.

As described above, it is possible to recognize that the steel strip for a blade according to the invention achieves the density of carbide necessary to exhibit satisfactory quenching properties without Mo.

The invention claimed is:

1. A method for manufacturing a steel strip for a blade that includes, in percent by mass, 0.55 to 0.80% C, 1.0% or less Si, 1.0% or less Mn, and 12.0 to 14.0% Cr with the remainder being Fe and inevitable impurities, the method comprising:

a batch annealing step for annealing in a vacuum a material for cold rolling having the aforementioned composition wound in a coil shape using a batch annealing furnace;

a cooling step for cooling the material is performed until a material temperature reaches 600 to 750° C.; and a cold rolling step for forming a steel strip by performing cold rolling one or more times on the material for cold rolling that has been batch annealed and cooled, wherein the batch annealing step includes a first uniform temperature step for maintaining heating for 2 to 5 hours at an internal furnace temperature exceeding 450° C. and less than 690° C. that is lower than a transformation point of the material to precipitate carbide, and a second uniform temperature step, carried out after the first uniform temperature step, for maintaining heating for 5 to 11 hours at an internal furnace temperature exceeding 800° C. and less than 900°° C. that is equal to or greater than the transformation point of the material to form the carbide into a spherical shape, wherein the steel strip for a blade does not contain Mo, wherein a metal structure of the steel strip for a blade is a ferrite structure in which a carbide is dispersed, and density of the carbide is 100 to 190 particles/100 $\mu m^2$.

2. The method for manufacturing a steel strip for a blade according to claim 1, wherein an average diameter of the carbide in the steel strip for a blade is 0.30 to 0.45 μm.

3. The method for manufacturing a steel strip for a blade according to claim 1, the batch annealing step includes the first uniform temperature step at an internal furnace temperature exceeding 450° C. and less than 530° C.

* * * * *